US011346090B2

(12) United States Patent
Gunawardena et al.

(10) Patent No.: US 11,346,090 B2
(45) Date of Patent: May 31, 2022

(54) AUTOMATED URINAL

(71) Applicant: AS America, Inc., Piscataway, NJ (US)

(72) Inventors: Mahendra Gunawardena, Hillsborough, NJ (US); Verne Myers, Fort Wayne, IN (US); Behnam Heydari, Ridgewood, NJ (US); Niloy Talukder, San Jose, CA (US); Nitin S. Kolekar, Piscataway, NJ (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 16/962,874

(22) PCT Filed: Jan. 18, 2019

(86) PCT No.: PCT/US2019/014149
§ 371 (c)(1),
(2) Date: Jul. 17, 2020

(87) PCT Pub. No.: WO2019/143905
PCT Pub. Date: Jul. 25, 2019

(65) Prior Publication Data

US 2020/0347587 A1 Nov. 5, 2020

Related U.S. Application Data

(60) Provisional application No. 62/619,202, filed on Jan. 19, 2018.

(51) Int. Cl.
*E03D 5/10* (2006.01)
*E03D 13/00* (2006.01)

(52) U.S. Cl.
CPC ..... *E03D 5/105* (2013.01); *E03D 13/00* (2013.01)

(58) Field of Classification Search
CPC ..... E03D 5/105; E03D 13/00
See application file for complete search history.

(56) References Cited

U.S. PATENT DOCUMENTS 3,751,736 A 8/1973 Egli
4,624,017 A * 11/1986 Foletta ..... E03D 5/105 4/304

(Continued)

FOREIGN PATENT DOCUMENTS

DE 10261283 A1 2/2004

OTHER PUBLICATIONS

International Search Report dated May 2, 2019 in corresponding International Application No. PCT/US2019/014149 (3 pages).

*Primary Examiner* — Janie M Loeppke
(74) *Attorney, Agent, or Firm* — Tyler A. Stevenson; Anna-lisa L. Gallo

(57) ABSTRACT

An automated urinal comprising a basin configured to receive a fluid; a wall; a trapway in fluid communication with the basin; a flush valve; and an automatic flush system; wherein, the automatic flush system comprises one or more sensors and a controller; the one or more sensors are selected from a group consisting of a first sensor coupled to an exterior of the trapway, a second sensor coupled to a rear surface of the wall, and a third sensor coupled to an underside of the basin; the controller is in electrical communication with the one or more sensors and is in electrical communication with the flush valve; and wherein the automatic flush system is configured to detect introduction of fluid into the basin and to send a flush signal to the flush valve to initiate a flush.

16 Claims, 4 Drawing Sheets

(56) References Cited

U.S. PATENT DOCUMENTS

| | | | | |
|---|---|---|---|---|
| 6,061,843 | A | 5/2000 | Rump et al. | |
| 6,535,134 | B2 | 3/2003 | Lang et al. | |
| 8,136,174 | B2 * | 3/2012 | Ito | E03D 13/00 4/309 |
| 8,479,324 | B2 | 7/2013 | Chen et al. | |
| 8,713,721 | B2 | 5/2014 | Zhang et al. | |
| 9,657,471 | B2 * | 5/2017 | Denzin | B23P 19/00 |
| 10,732,010 | B2 * | 8/2020 | Claes | G01D 5/24 |
| 2015/0020298 | A1 * | 1/2015 | Hsu | E03D 13/00 4/305 |

* cited by examiner

AUTOMATED URINAL

The present invention generally relates to a urinal and, in some embodiments, to an automated urinal having a sensor to detect fluid.

BACKGROUND

Automated urinals, meaning a urinal that flushes without actuation from the user, are typically used in commercial and public bathrooms. Automated urinals may help reduce the spread of germs by flushing without requiring a user to touch the urinal and may also help to keep the urinal clean by ensuring that the urinal is flushed after each use. Automated urinals may use sensors to detect the presence of a user or the introduction of fluid into a urinal.

Sensors which detect a person may be falsely triggered by a person standing near, but not utilizing, the urinal. Person-detecting sensors used in public spaces are also exposed and can be easily vandalized requiring costly repairs or replacement. Automated urinals may include a sensor to detect when the urinal has been used and trigger a controller to initiate a flush. However, urinal screens or cakes used in commercial and public bathrooms to reduce urine splash and odor and trash discarded into a bowl may interfere with a sensor. A cake or trash within the urinal positioned proximate to a sensor may falsely trigger the sensor and prevent the urinal from working properly. The position of a urinal screen, cake or trash may be difficult to predict and may vary depending on the screen or cake selected and the installer and the size and shape of the urinal. Further, moisture between an object in the basin of the urinal and a surface of the urinal may also cause a sensor to erroneously detect a standing water event.

Thus, an improved automated urinal sensor system is desired.

These and other features, aspects, and advantages of the disclosure will be apparent from a reading of the following detailed description together with the accompanying drawings, which are briefly described below. The invention includes any combination of two, three, four, or more of the disclosed embodiments as well as combinations of any two, three, four, or more features or elements set forth in this disclosure, regardless of whether such features or elements are expressly combined in a specific embodiment description herein. This disclosure is intended to be read such that any separable features or elements of the disclosed invention, in any of its various aspects and embodiments, should be viewed as intended to be combinable unless the context clearly dictates otherwise. Other aspects and advantages of the present invention will become apparent from the following.

SUMMARY

Disclosed is an automated urinal comprising a basin configured to receive a fluid; a wall; a trapway in fluid communication with the basin; a flush valve; and an automatic flush system; wherein, the automatic flush system comprises one or more sensors and a controller; the one or more sensors are selected from a group consisting of a first sensor coupled to an exterior of the trapway, a second sensor coupled to a rear surface of the wall, and a third sensor coupled to an underside of the basin; the controller is in electrical communication with the one or more sensors and is in electrical communication with the flush valve; and wherein the automatic flush system is configured to detect introduction of fluid into the basin and to send a flush signal to the flush valve to initiate a flush.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1:
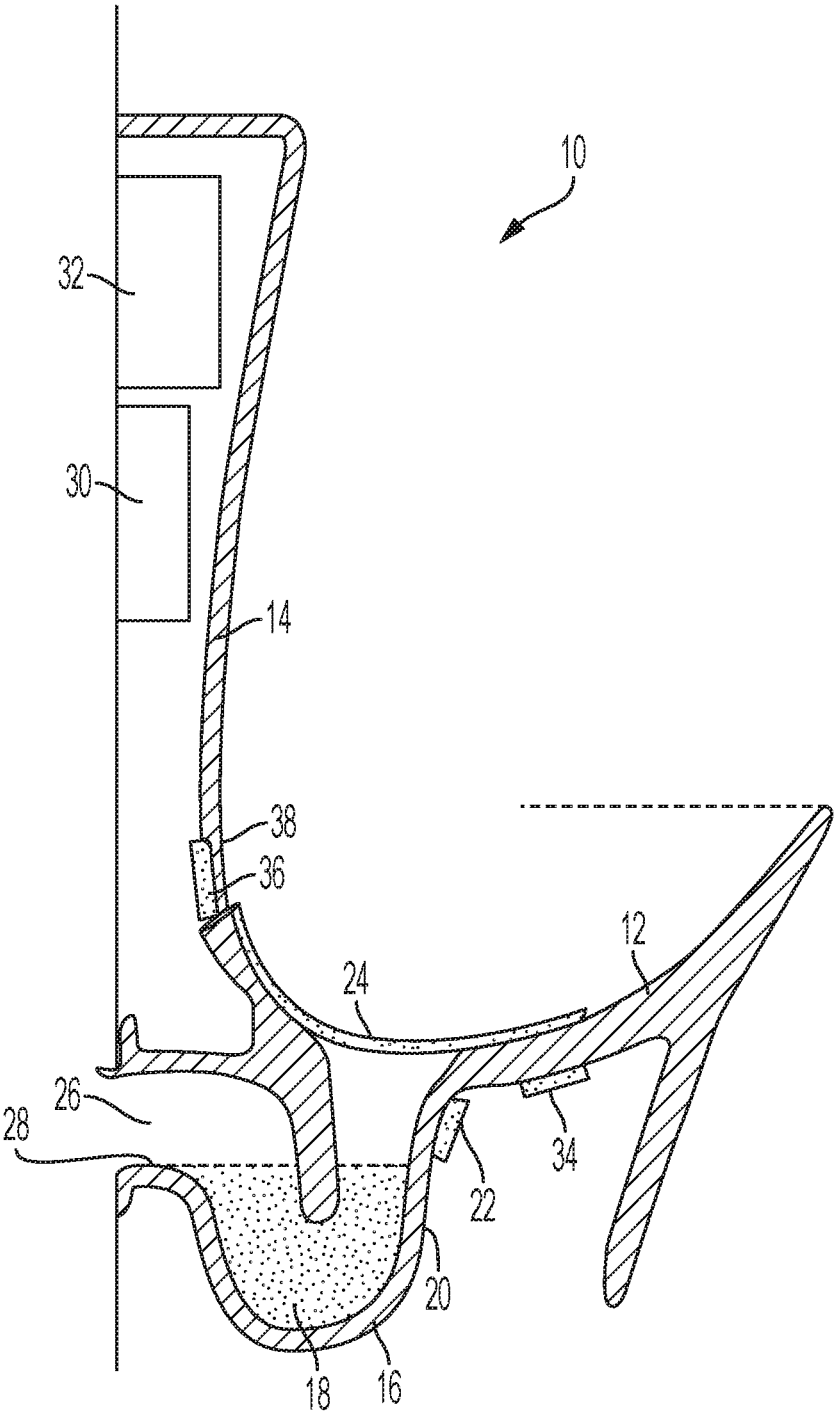
FIG. 1 is a left side sectional view of an automated urinal in accordance with an embodiment of the invention.

The urinal of the present invention includes one or more sensors configured to detect the presence of or introduction of fluid or urine and reduce false triggers. The urinal includes a controller (microcontroller) configured to communicate with the one or more sensors and to generate a flush signal. A flush valve may flush the urinal in response to receiving a flush signal from the controller. A sensor may be positioned such that a urinal cake, urinal screen, or trash within the urinal does not negatively impact the performance of the sensor regardless of the position of the urinal cake, screen, or trash within a basin. In some embodiments, a sensor may be located behind, or embedded in, the urinal such that the sensor is not exposed to introduced liquid or a user. The sensor may be configured to detect a clog event and communicate this to the controller to prevent flushing of the urinal.

Referring to the drawings, wherein like reference numerals indicate like elements, there is shown a urinal 10, in accordance with some embodiments of the invention.

Referring to FIG. 1, urinal 10 includes a basin 12 configured to receive a fluid (e.g., urine). Urinal 10 includes a wall 14 coupled to basin 12. Basin 12 is in fluid communication with a trapway 16. Trap 16 may be fluidly connected to a sewer line. Trap 16 is configured to hold fluid (water) 18 that prevents backflow of gas from the sewer (a water seal). A urinal mat 24 or urinal cake may be positioned in basin 12.

Urinal 10 may include a sensor 22 configured to detect introduction of fluid into basin 12. Sensor 22 may be configured to generate a signal (e.g., an electrical or electromagnetic signal) toward basin 12 and/or trap 16. Sensor 22 is configured to be in electrical communication with controller 30. Controller 30 is configured to send a flush signal to a flush valve 32 to flush urinal 10. Sensor 22 may be positioned below urinal mat 24. Sensor 22 may be configured to detect the presence of fluid within a detection area and sensor 22 may be positioned and oriented such that urinal mat 24 or other objects in a urinal do not impact sensor performance (e.g., a urinal mat is not within the detection area).

Still referring to FIG. 1, trap 16 includes a sidewall 20 coupled to basin 12. Sidewall 20 may extend above the level of trap fluid 18. Sensor 22 may be coupled to sidewall 20 above the level of trap fluid 18 such that the trap fluid 18 does not interfere with the performance of sensor 22 during normal operation (e.g., when the urinal is not in use). Trap 16 may include an exit pipe 26 configured to be coupled to a sewer line and sensor 22 may be positioned above a lower edge 28 of exit pipe 26 such that fluid flows through trap 16 and out of exit pipe 26 without fluid building up within trap 16 and obscuring the detection area. Urinal 10 may be manufactured with sensor 22 embedded therein. A kit may include sensor 22 and be configured for retrofitting onto existing urinals. Sensor 22 in a kit may be coupled to a urinal or to a trapway. A kit may include a trapway with a sensor mounted thereon that can be retrofitted to an existing urinal.

Urinal 10 may include a sensor 34 coupled to basin 12 and configured to detect the presence of fluid and/or the presence of a user (e.g., a user's foot). Sensor 34 is positioned below basin 12 and is configured to detect the presence of fluid (e.g., standing fluid or the flow of fluid) in basin 12. Sensor 34 is positioned beneath basin 12 such that sensor 34 does not contact the fluid. Sensor 34 is configured to be in electrical communication with controller 30. In some embodiments, controller 30 is configured to send a flush signal to flush valve 32 after receiving input from one of sensor 22 or sensor 34. In other embodiments, controller 30 is configured to send a flush signal after receiving input from both 22 and 34.

Figure 2:
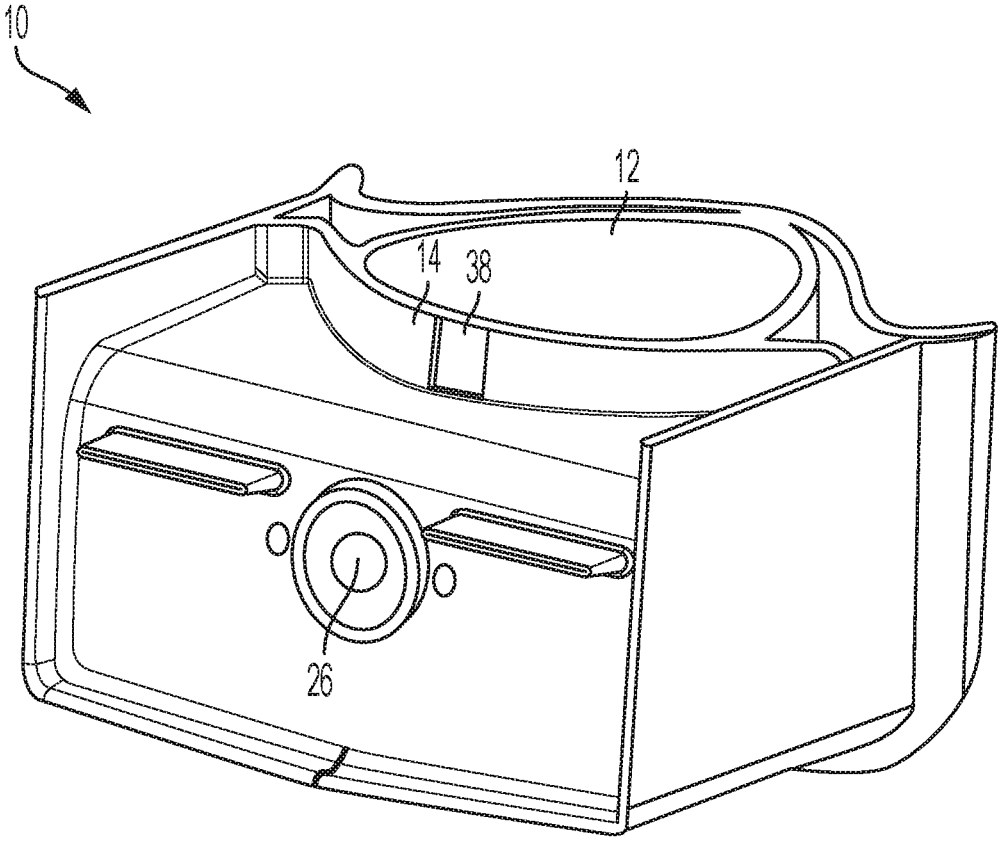
FIG. 2 is a rear, left-side perspective, sectional view of an automated urinal of an embodiment.

Referring to FIG. 1 and FIG. 2, urinal 10 may include a sensor 36 behind wall 14. The wall may have a wall thickness of from any of about 0.10 inches, about 0.25 inches, about 0.50 inches, or about 0.75 inches to any of about 1.00 inches, about 1.25 inches, about 1.50 inches, about 1.75 inches, about 2.00 inches, or more. Wall 14 may include a sensor receiving area 38 configured to receive sensor 36. A sensor receiving area 38 may have a reduced thickness compared to an adjacent portion of wall 14. A sensor receiving area 38 may have a thickness of from any of about 0.10 inches, about 0.25 inches, about 0.50 inches, or about 0.75 inches to any of about 1.00 inches, about 1.25 inches, about 1.50 inches, about 1.75 inches, about 2.00 inches, or more. A receiving area having a reduced thickness may provide for better performance of a sensor as there may be less interference with a sensor signal. At least one of sensor 22, sensor 34, and sensor 36 may not be visible to a user when they are using urinal 10. Sensor 36 is configured to be in electrical communication with controller 30. In some embodiments, controller 30 is configured to send a flush signal to flush valve 32 when controller 30 receives input from one of 22, 34 and 36. In other embodiments, controller 30 is configured to send a flush signal to flush valve 32 when controller 30 receives input from at least two of 22, 34 and 36. In still other embodiments, controller 30 is configured to send a flush signal after receiving input from all three of 22, 34 and 36. Controller 30 may send a flush signal after a predetermined delay after receiving input from one or more sensors. In an embodiment, input received from sensor 22, and/or 34, and/or 36 by controller 30 may be continuous or intermittent.

Figure 3:
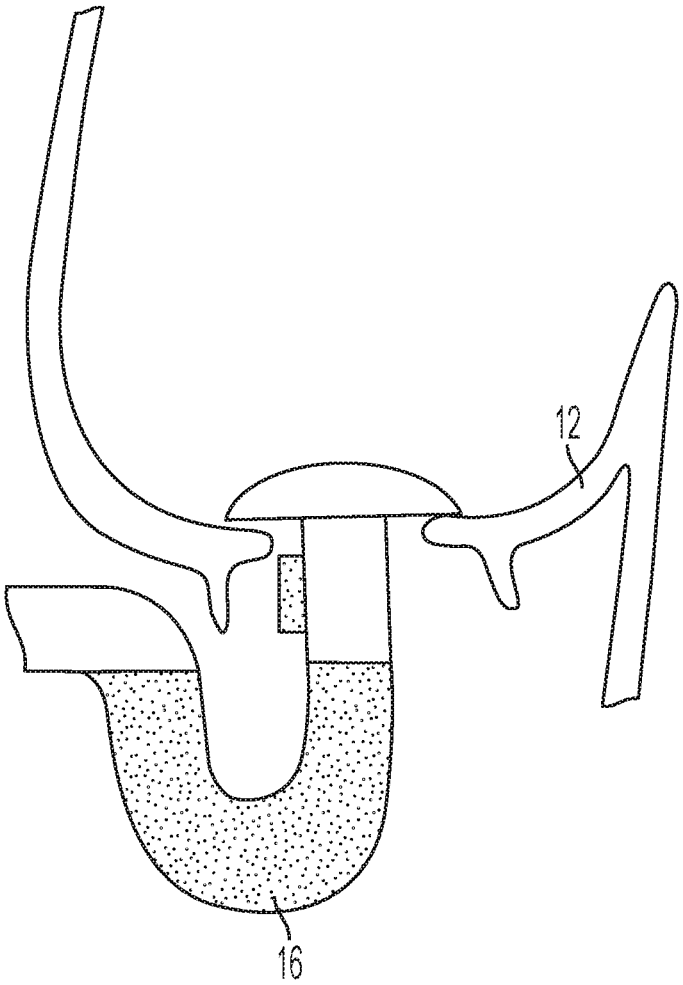
FIG. 3 is a left side sectional view of an automated urinal in accordance with an embodiment.

Referring to FIG. 1 and FIG. 3, in some embodiments, basin 12 and trap 16 are a unitary construct manufactured from a same material (e.g., plastic, metal, or porcelain) (FIG. 1). In other embodiments, basin 12 and trap 16 are separate elements that are coupled together (FIG. 3). Basin 12 may be manufactured from a first material (e.g., plastic, metal, or porcelain) and trap 16 may be manufactured from a second material (e.g., plastic, metal, or porcelain). A first material may be different than a second material.

Figure 4:
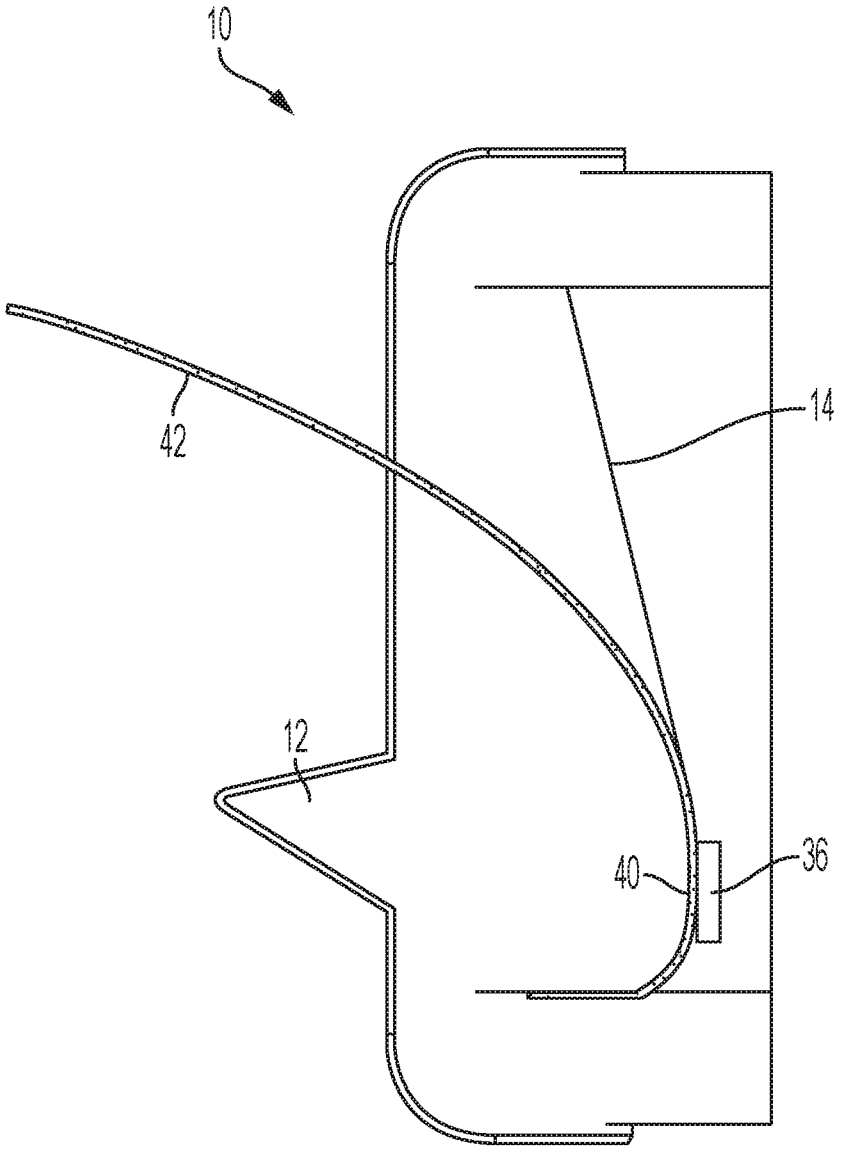
FIG. 4 is a right side sectional view of an automated urinal in accordance with an embodiment.

Referring to FIG. 4, wall 14 may be configured to direct fluid 42 toward a detection area 40. Wall 14 may include a groove or an angled portion such that fluid that enters urinal 10 is directed toward the detection area.

The urinals will comprise a basin to receive fluid (e.g. urine), a wall, a trapway in fluid communication with the basin (e.g. a p-trap or s-trap), a flush valve and an automatic flush system. The automatic flush system comprises one or more sensors and a controller (microcontroller).

In some embodiments, a sensor attached to an exterior wall of a trapway, for instance a capacitive sensor, is attached to a front exterior wall of a trapway, as in FIG. 1.

A sensor may comprise a transmitter, a receiver or both a transmitter and a receiver. In other embodiments, a sensor may comprise only a transmitter or only a receiver. In some embodiments, a sensor may be configured to be in electrical communication with another sensor, for instance, one may transmit information and one may receive information. In some embodiments, a sensor may be a capacitive sensor. In other embodiments, a sensor may be an infrared a piezo-electric sensor, ultrasonic, field-effect, radar or temperature sensor.

In certain embodiments, a sensor may be a capacitive touch sensor or a field-effect sensor. These type of sensors create an electromagnetic field over a certain area. Liquid passing through the electromagnetic field will disrupt it, which disruption may be communicated to a controller. In some embodiments, upon communication of a disruption indicating fluid flow into the basin, or upon communication that fluid has stopped being introduced into the basin, the controller will send a flush signal to a flush valve to initiate a flush.

A sensor may be coupled to a trapway, wall or basin underside using a mechanical fastener (e.g., screw or rivet), adhesive, magnet, or embedded in the urinal material. In some embodiments, a sensor is not visible to a user. In certain embodiments, a sensor may be located on an outer surface of a trapway. A trapway may comprise a plastic, for example PVC or ABS. A sensor may be embedded in a plastic trapway assembly.

A controller is in electrical communication with the one or more sensors. A controller may be in electrical communication with a sensor via a wire (wired connection/hard wired), or may be in communication with a sensor via wireless communication, for example near field communication, Bluetooth® or ZigBee communication protocols. A controller is also in electrical communication with a flush valve. A controller may likewise be in electrical communication with a flush valve via a wired or wireless communication. A controller is configured to receive input from a sensor and to provide input to a flush valve.

In some embodiments, there is one controller per urinal. In other embodiments, for example a restroom containing 2, 3, 4 or more urinals, there may be one controller for a series (the series) of urinals.

The automatic flush system is configured to detect introduction of fluid into the urinal basin. The automatic flush system may be configured to detect introduction of fluid into a trapway, against a wall or directly into a basin. The automatic flush system may be configured to detect "fluid flow", that is, moving or flowing fluid. The automatic flush system may also be configured to detect standing fluid or non-moving fluid. The term "introduction of fluid" generally means flowing fluid. Detection of fluid may mean detection flowing or standing fluid.

In some embodiments, a one or more sensor is positioned so as not to be influenced by trap water. That is to say, a sensor may be positioned so that trap water will not impact performance of the automatic flush system. In some embodiments, the one or more sensors are positioned above a level of trap water. In other embodiments, the one or more sensors are positioned above a lower edge of an exit pipe—a pipe coupled to a sewer line. In certain embodiments, a sensor is positioned on or embedded in a trapway above the trap water line in a position such that liquid entering a urinal will pass over the sensor.

The automatic flush system may be powered by a power source. In some embodiments, a power source may be a battery or other electrical source. In some embodiments, the automatic flush system, including the one or more sensors, are never in contact with fluid introduced into the basin. In some embodiments, the one or more sensors are positioned such that a temporary object in the basin will not/does not impact performance of the automatic flush system. Temporary objects in a basin may include a urinal cake, a screen, a mat, trash, and the like.

The automatic flush system may comprise an analog front end, an amplifier or an analog to digital converter.

In some embodiments, an automatic flush system may have a timer or clock associated with it. In some embodiments, a sensor may be configured to detect an abnormal urinal state, for example a clog state, slow-drain state, or a leak state. The sensor may communicate this to the controller, which may be configured to not send any flush signal to a flush valve during detection of an abnormal state. Likewise, the automatic flush system may also be configured to detect a normal urinal state, that is, wherein fluid flow is normal to and through the basin and trap. In a clog state or slow-drain state, water may not drain from the basin to and through the trapway, or may do so only slowly. If a flush valve is leaking (i.e. a leak state), a sensor may detect a "permanent" introduction of liquid into a urinal basin (permanent meaning until it is repaired). Detection of a normal and abnormal state may be enabled with a timer. For instance, if one or more sensors detects fluid for a period of time deemed "too long", this would indicate a urinal abnormal state and the controller would not send any flush signal until a normal state is again detected. In some embodiments, detection of fluid for more than from any of about 45 seconds, about 1 minute, about 2 minutes, about 3 minutes or about 4 minutes to any of about 5 minutes, about 6 minutes, about 7 minutes or more may indicate an abnormal state. In some embodiments, a timer may be a time-to-digital converter, or "time digitizer". In some embodiments, when an abnormal state is detected, the controller may communicate this to a visual or an auditory element. The controller may be in electrical communication with a visual and/or an auditory element, for instance a light or a speaker. Upon receiving an abnormal state communication, the visual and/or auditory element may display this, for instance via light and/or sound.

In some embodiments, an automatic flush system may be configured to determine if remaining battery life is low, for instance below a threshold value. This may also be considered an abnormal state where the system may be configured to not send any flush signal until a normal state is again detected.

In some embodiments, an automatic flush system may be configured to indicate an abnormal state to a user and/or a technician. Such an indication may comprise an auditory and/or visual signal observable by a user and/or a technician. Such an indication may be observable by only a technician, for instance in a control room.

A urinal wall may comprise a concave shape or another shape configured to deflect or guide fluid towards basin and towards one or more sensors. In this way, detection of fluid by a sensor may be enhanced. A urinal wall is in fluid communication with the basin.

The flush valve in some embodiments is in fluid communication with a water source. The flush valve may be an electromechanical valve, e.g. a solenoid valve. The trapway is configured to be coupled to a sewer line (an outgoing waste line). The trapway may be coupled to and in fluid communication with a sewer line. Upon receiving a flush signal from the automatic flush system, the flush valve will initiate a water flush of the urinal.

The automatic flush system will communicate a "flush signal" to the flush valve as programmed. The automatic flush system may communicate a flush signal after detection of fluid flow into the basin. A mammal on average urinates for about 21 seconds, or about 0.35 minutes at a time. The flush signal may be communicated after a certain period of time elapses after a detection of fluid flow, for instance, a time period of from any of about 0.3 minutes, about 0.4 minutes, about 0.5 minutes, about 0.6 minutes, about 0.7 minutes, about 0.8 minutes, about 0.9 minutes or about 1.0 minutes to any of about 1.2 minutes, about 1.5 minutes, about 2.0 minutes, about 2.5 minutes, about 3.0 minutes, about 4.0 minutes, about 5.0 minutes or longer.

An average male urinates at a rate of from about 9 mL/second to about 21 mL/second, depending on age. In some embodiments, an automatic flush system may be configured to detect introduction of urine into the basin, based on detection of a rate of introduction of fluid of from about 8 mL/second to about 35 mL/second. An automatic flush system may be configured to not send a flush signal to initiate a flush if detection of fluid is not a fluid flowing within this rate range.

In other embodiments, an automatic flush system may be configured to detect an introduction of fluid into the basin and also to detect when fluid is no longer being introduced into the basin, that is, when fluid flow stops. In other words, the automatic flush system may be configured to determine fluid introduction "start" and "stop". A flush signal may be communicated upon a detection that fluid is no longer being introduced ("stop"). A flush signal may be communicated after a certain period of time elapses after a detection that fluid is no longer being introduced. For instance a time period of from any of about 0.5 seconds, about 1 second, about 2 seconds, about 3 seconds, about 4 seconds, about 5 seconds, about 6 seconds, about 7 seconds, about 8 seconds, about 9 seconds or about 10 seconds, to any of about 0.2 minutes, about 0.3 minutes, about 0.4 minutes, about 0.5 minutes, about 0.6 minutes, about 0.7 minutes, about 0.8 minutes, about 0.9 minutes, about 1.0 minutes, or longer.

In some embodiments, a flush signal sent to a flush valve to initiate a flush will result in the flush valve introducing a typical amount of flush water into the basin. In some embodiments, the amount of flush may vary from any of about 0.3 liters, about 0.4 liters, about 0.5 liters, about 0.6 liters, about 0.7 liters, about 0.8 liters, about 0.9 liters or about 1.0 liters to any of about 1.2 liters, about 1.5 liters, about 2.0 liters, about 2.5 liters, about 3.0 liters, about 3.5 liters, about 4.0 liters, about 4.5 liters or about 5.0 liters.

In some embodiments, a duration of a flush may be from any of about 0.5 seconds, about 1.0 seconds, about 1.5 seconds, about 2.0 seconds or about 2.5 seconds, to any of about 3.0 seconds, about 3.5 seconds, about 4.0 seconds, about 4.5 seconds, or longer.

Some users may not provide a steady fluid flow or, the presence of a urinal screen or cake or other obstruction may result in the appearance of a non-steady or intermittent fluid flow to one or more sensors. Thus, initiating a flush after a certain time period after detection of fluid introduction or after a certain time period after detection that fluid is no longer being introduced may prevent unnecessary multiple flushes and conserve water.

In some embodiments, an automatic flush system is programmed so as not to send a flush signal to initiate a flush more than once within a certain time period, for example, within a time period of about 0.4 minutes, about 0.5 minutes, about 0.6 minutes, about 0.7 minutes, about 0.8 minutes, about 0.9 minutes, about 1.0 minutes, about 1.2 minutes, about 1.5 minutes, about 2.0 minutes, about 2.5 minutes, about 3.0 minutes, about 3.5 minutes, about 4.0 minutes, about 4.5 minutes, about 5.0 minutes, or longer. In this way, unnecessary flushes are prevented and water is conserved.

In some embodiments, wherein an automatic flush system is configured to detect an introduction of fluid into the basin and to detect when fluid is no longer being introduced into the basin, the automatic flush system may be configured to not send a flush signal upon detection of another introduction of fluid into the basin within a time period of from any of about 2 seconds, about 3 seconds, about 4 seconds or about 5 seconds, to any of about 6 seconds, about 7 seconds, about 8 seconds, about 9 seconds or about 10 seconds. These time periods are between a detection of a "stop" in fluid flow and a detection of a further fluid flow "start".

In some embodiments, wherein an automatic flush system is configured to detect a fluid introduction "start" and "stop" and to communicate a flush signal a certain period of time after the stop (first period of time), it may also be configured to not send a flush signal upon detecting another "start" until a second period of time elapses (between "stop" and "start"). The second period of time may be greater than or equal to the first period of time. The first and second periods of time may be for instance from any of about 0.5 seconds, about 1 second, about 2 seconds, about 3 seconds, about 4 seconds, about 5 seconds or about 6 seconds, to any of about 7 seconds, about 8 seconds, about 9 seconds, about 10 seconds, about 20 seconds, about 30 seconds, or longer. This ensures that not more than one flush is performed per user.

In some embodiments, an automatic flush system may be programmed to send a flush signal to a flush valve only depending on an irregular or regular time interval, not depending on a detection of fluid introduction. This may be suitable for "high traffic" use periods, for example in restrooms of stadiums or other venues during sporting events, concerts and the like or for example in restrooms of airports, bus or train terminals, or highway rest stops. In this way, a large amount of water (flush water) may be conserved. When not in a high traffic period, an automatic flush system may be returned to an operating state wherein the communication of a flush signal depends on detection of fluid introduction. In a high traffic or high use scenario, an automatic flush system programmed not to send more than one flush signal within a defined time period may be advantageous. In other embodiments of a high use scenario, an automatic flush system may be programmed to actuate the flush valve after each use, or after every 2, 3, 4 or more uses. The amount of flush water may be programmed to be less than a typical normal amount of flush water. This situation may be termed a "high-use mode".

In other embodiments, an automatic flush system may be programmed to send a periodic flush signal to clean the drain lines periodically to prevent scale build-up. Such a periodic sanitary flush may actuated for example once every 24 hours, once every 18 hours, once every, 12 hours, once every 8 hours, once every 4 hours, or once every 2 hours. The flush system may be programmed depending on anticipated usage. In some embodiments, a period sanitary flush may be performed depending on the number of "normal" flushes (a number of times a urinal is used); for example, an automatic flush system may be programmed to actuate a sanitary flush after about 4 times, after about 8 times, after about 12 times, after about 16 times, after about 20 times, or after about 24 times or more that a urinal is used as determined by the system. A sanitary flush may employ about the same amount or more flush water than a typical amount. In some embodiments, an amount of flush water of a sanitary flush may be from any of about 2.0 liters, about 2.5 liters, about 3.0 liters, about 3.5 liters, about 4.0 liters, about 4.5 liters, about 5.0 liters or about 5.5 liters to any of about 6.0 liters, about 6.5 liters, about 7.0 liters, about 7.5 liters, about 8.0 liters, about 8.5 liters, or about 9.0 liters or more. This may be termed a "periodic sanitary flush mode". A sanitary flush may aid in keeping waste pipes clear of mineral build-up, e.g. struvite build-up.

The automatic flush system may also comprise a "cleaning mode". In a cleaning mode, the system may be temporarily disabled. This may be programmed to automatically occur if an abnormal state is detected. In other embodiments, a urinal may comprise an on/off switch or a dedicated sensor that may be communicated with by only a technician with knowledge of its location.

In some embodiments, an automatic flush system may be programmed to send a flush signal to initiate a flush at least once within a certain time period, for example, within a time period of about 1 hour, about 2 hours, about 3 hours, about 4 hours, about 5 hours, about 6 hours, about 7 hours, about 8 hours, about 9 hours, about 10 hours, about 11 hours, 14 hours, about 17 hours, about 20 hours, about 22 hours, about 24 hours, or longer. In this way, a urinal may be cleaned and a water seal in a trap may be maintained during a low-use period—a "low-use mode".

An automatic flush system may be programmed for any combination or for each of a high-use mode, a low-use mode and a periodic sanitary flush mode.

In some embodiments, an automatic flush system may be configured to not send a flush signal upon receiving an indication that a battery life is below a threshold value.

In certain embodiments, an automatic flush system may be configured to indicate an abnormal state In some embodiments, the automatic flush system may comprise one of the first, second or third sensors, or may comprise any two of the first, second or third sensors, or may comprise all three of the first, second and third sensors.

In some embodiments, the automatic flush system is configured to detect introduction of fluid into the basin and to send the flush signal after communication between one of the first, second or third sensors and the controller. In other embodiments, the flush system is configured to detect introduction of fluid into the basin and to send the flush signal after receiving input from any two of the first, second and third sensors. In some embodiments, the flush system is configured to detect introduction of fluid into the basin and to send the flush signal to initiate a flush after communicating with all three of the first, second and third sensors.

In certain embodiments, an automatic flush system is configured to communicate with two different sensors. For example a restroom and/or a urinal may comprise a presence sensor such as an infrared, ultrasonic or a radar sensor. A urinal may comprise a "liquid introduction sensor", for example a capacitive sensor, for example on a trapway above the trap water line. An automatic flush system may be configured to only initiate a flush upon communication from both sensors that a user is in the restroom and/or at a urinal and that a liquid is introduced into the urinal. In other embodiments, an automatic flush system may comprise two different liquid introduction sensors wherein a controller must communicate with a first sensor to determine liquid introduction is occurring, and with a second sensor to confirm liquid introduction is occurring or has occurred prior to initiating a flush. A second sensor may communicate a liquid introduction after a certain time period has elapsed after the first sensor has communicated a liquid introduction. For instance, after a time period of about 10 seconds, about 12 seconds, about 14 seconds, about 16 seconds, about 18 seconds or about 20 seconds. Such configurations employing multiple sensors may prevent "false events" and prevent unnecessary flushes, thereby conserving water.

Following are some further non-limiting embodiments of the invention.

In a first embodiment, disclosed is an automated urinal comprising a basin configured to receive a fluid; a wall; a trapway in fluid communication with the basin; a flush valve; and an automatic flush system; wherein, the automatic flush system comprises one or more sensors and a controller; the one or more sensors are selected from a group consisting of a first sensor coupled to an exterior of the trapway, a second sensor coupled to a rear surface of the wall, and a third sensor coupled to an underside of the basin; the controller is in electrical communication with the one or more sensors and is in electrical communication with the flush valve; and wherein the automatic flush system is configured to detect introduction of fluid into the basin and to send a flush signal to the flush valve to initiate a flush.

In a second embodiment, disclosed is a urinal according to the first embodiment, wherein the one or more sensors are in electrical communication with the controller via wired communication or wireless communication. In a third embodiment, disclosed is a urinal according to the first or second embodiments, wherein the controller is in electrical communication with the flush valve via wired communication or wireless communication.

In a fourth embodiment, disclosed is a urinal according to any of the preceding embodiments wherein the automatic flush system comprises a timer.

In a fifth embodiment, disclosed is a urinal according to any of the preceding embodiments, wherein the automatic flush system is configured to send the flush signal after detecting an introduction of fluid into the basin. In a sixth embodiment, disclosed is a urinal according to any of the preceding embodiments, wherein the automatic flush system is configured to send the flush signal after a period of time elapses after detecting an introduction of fluid into the basin.

In a seventh embodiment, disclosed is a urinal according to any of the preceding embodiments, wherein the automatic flush system is configured to detect introduction of fluid into the basin and to detect when the fluid is no longer being introduced into the basin. In an eighth embodiment, disclosed is a urinal according to any of the preceding embodiments, wherein the automatic flush system is configured to detect introduction of fluid into the basin, to detect when the fluid is no longer being introduced into the basin and to send the flush signal after detecting that fluid is no longer being introduced into the basin. In a ninth embodiment, disclosed is a urinal according to any of the preceding embodiments, wherein the automatic flush system is configured to detect introduction of fluid into the basin, to detect when the fluid is no longer being introduced into the basin and to send the flush signal after a period of time elapses after detecting that fluid is no longer being introduced into the basin.

In a tenth embodiment, disclosed is a urinal according to any of the preceding embodiments, wherein the automatic flush system is configured to detect a urinal normal state and a urinal abnormal state. In an eleventh embodiment, disclosed is a urinal according to any of the preceding embodiments, wherein the automatic flush system is configured to detect a urinal abnormal state, and during a period of time that an abnormal state is detected, a flush signal is not sent.

In a twelfth embodiment, disclosed is a urinal according to any of the preceding embodiments, wherein the automatic flush system is configured to send a flush signal at a regular recurring time interval.

In a thirteenth embodiment, disclosed is a urinal according to any of the preceding embodiments, wherein the automatic flush system is configured to send a flush signal at an irregular recurring time interval.

In a fourteenth embodiment, disclosed is a urinal according to any of the preceding embodiments, comprising the first and second sensors. In a fifteenth embodiment, disclosed is a urinal according to any of the preceding embodiments, comprising the first and third sensors. In a sixteenth embodiment, disclosed is a urinal according to any of the preceding embodiments, comprising the second and third sensors. In a seventeenth embodiment, disclosed is a urinal according to any of the preceding embodiments, comprising the first, second and third sensors.

In a eighteenth embodiment, disclosed is a urinal according to any of the preceding embodiments, wherein the automatic flush system is configured to detect introduction of fluid into the basin and to send the flush signal after communication between one of the first, second or third sensors and the controller. In a nineteenth embodiment, disclosed is a urinal according to any of the preceding embodiments, wherein automatic flush system is configured to detect introduction of fluid into the basin and to send the flush signal after communication between the first sensor and the controller and the second sensor and the controller. In a twentieth embodiment, disclosed is a urinal according to any of the preceding embodiments, wherein automatic flush system is configured to detect introduction of fluid into the basin and to send the flush signal after communication between the first sensor and the controller and the third sensor and the controller. In a twenty-first embodiment, disclosed is a urinal according to any of the preceding embodiments, wherein automatic flush system is configured to detect introduction of fluid into the basin and to send the flush signal after communication between the second sensor and the controller and the third sensor and the controller. In a twenty-second embodiment, disclosed is a urinal according to any of the preceding embodiments, wherein automatic flush system is configured to detect introduction of fluid into the basin and to send the flush signal after communication between each of the first, second and third sensors and the controller.

In a twenty-third embodiment, disclosed is a urinal according to any of the preceding embodiments, comprising at least two of the first, second and third sensors, wherein one of the sensors is configured to detect a urinal normal state and a urinal abnormal state and the other is configured to detect introduction of fluid into the basin. In a twenty-fourth embodiment, disclosed is a urinal according to any of the preceding embodiments, wherein at least one of the first sensor, second sensor and third sensor is configured to detect a user. In a twenty-fifth embodiment, disclosed is a urinal according to any of the preceding embodiments, wherein the sensor is not visible to a user.

In a twenty-sixth embodiment, disclosed is a urinal according to any of the preceding embodiments, wherein the wall comprises a shape configured to direct fluid flow towards the sensor.

In a twenty-seventh embodiment, disclosed is a urinal according to any of the preceding embodiments, wherein the sensor is a capacitive sensor, an infrared sensor or a piezo-electric sensor. In a twenty-eighth embodiment, disclosed is a urinal according to any of the preceding embodiments, wherein the automatic flush system comprises a capacitive sensor. In a twenty-ninth embodiment, disclosed is a urinal according to any of the preceding embodiments, wherein the automatic flush system comprises a capacitive sensor and one or more of an infrared, piezo-electric, ultrasonic and temperature sensors.

In a thirtieth embodiment, disclosed is a urinal according to any of the preceding embodiments, wherein the automatic flush system is configured to not send more than one flush signal during a time period of about 0.5 minutes.

In a thirty-first embodiment, disclosed is a urinal according to any of the preceding embodiments, wherein the one or more sensors are positioned above a level of trap water and/or are positioned above a lower edge of an exit pipe.

A further embodiment includes an automatic flush system according to any of the preceding embodiments.

Further embodiments include methods for conserving water, the methods comprising providing or operating a urinal according to any of the preceding embodiments.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "above", "below", and "behind" designate directions in the drawings to which reference is made.

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "coupled" means that an element or feature is "attached to" or "associated with" another element or feature. Coupled may mean directly coupled or coupled through one or more other elements. An element may be coupled to an element through two or more other elements in a sequential manner or a non-sequential manner. Coupled or "associated with" may also mean elements not directly or indirectly attached, but that they "go together" in that one may function together with the other.

EXAMPLE

A test urinal is connected to a trapway and a capacitive sensor is fitted to the exterior front wall of the trapway. The urinal is equipped with an electronic flush valve. An ARDUINO circuit board and an ADAFRUIT Motor Shield are employed as a controller. The controller is in wired electronic communication with the sensor and the flush valve. A robotic system is designed to control and simulate introduction of urine into the urinal basin. The sensor detects the introduction of simulated urine into the urinal basin and when the introduction of simulated urine stops and communicates this to the controller. After a delay of about 5 seconds after the simulated urine flow stops, the controller sends a flush signal to the flush valve to actuate a flush. When the system detects a further introduction of simulated urine within a time period from urine flow "stop" to urine flow "start", it is configured to not send a flush signal if the time period is less than about 5 seconds.

If the sensor detects liquid for more than about 1 minute, about 1.5 minutes or about 2 minutes, it is determined that the urinal is clogged. If the sensor detects liquid for more than about 45 seconds, about 60 seconds, about 75 seconds or about 90 seconds, a slow drain state is determined. Upon a determination of one or more of these abnormal urinal states, the controller is configured to communicate this to a visual display and/or an auditory element to alert a user and/or facilities manager.

The invention claimed is:

1. An automated urinal comprising
a basin configured to receive a fluid;
a wall;
a trapway in fluid communication with the basin;
a flush valve; and
an automatic flush system,
wherein,
the automatic flush system comprises a first capacitive sensor, a second capacitive sensor, an infrared presence sensor, and a controller,
the first capacitive sensor is coupled to a rear surface of the wall, the second capacitive sensor coupled to an underside of the basin, and
the controller is in electrical communication with the first and second capacitive sensors and is in electrical communication with the flush valve,
wherein,
the automatic flush system is configured
to detect introduction of a fluid into the basin,
to detect a urinal normal state wherein the fluid flows through the basin and trapway over a defined period of time, to detect a urinal abnormal clog state or abnormal slow-drain state wherein the fluid does not drain from the basin through the trapway, or drains from the basin slowly for more than a defined period of time, and to detect a urinal abnormal flush valve leak state wherein the fluid is introduced to the basin for more than a defined period of time, and wherein, the automatic flush system is configured to send a flush signal to the flush valve to initiate a flush if the urinal is in the normal state, and to not send a flush signal to the flush valve to initiate a flush if the urinal is in the abnormal clog state, the abnormal slow-drain state, or the abnormal flush valve leak state.

2. The urinal of claim 1, wherein the first and second capacitive sensors are in wired electrical communication with the controller, and the controller is in wired electrical communication with the flush valve.

3. The urinal of claim 1, wherein the automatic flush system comprises a timer.

4. The urinal of claim 1, wherein the automatic flush system is configured to send the flush signal after a period of time elapses after detecting an introduction of fluid into the basin.

5. The urinal of claim 1, wherein the automatic flush system is configured to detect introduction of fluid into the basin, to detect when the fluid is no longer being introduced into the basin and to send the flush signal after detecting that fluid is no longer being introduced into the basin.

6. The urinal of claim 1, wherein the automatic flush system is configured to detect introduction of fluid into the basin, to detect when the fluid is no longer being introduced into the basin and to send the flush signal after a period of time elapses after detecting that fluid is no longer being introduced into the basin.

7. The urinal of claim 6, wherein the period of time is from about 10 seconds to about 60 seconds.

8. The urinal of claim 1, wherein the automatic flush system is configured to send a flush signal at a regular or an irregular recurring time interval.

9. The urinal of claim 1, wherein the first capacitive sensor is coupled to the wall rear surface, and the second capacitive sensor is coupled to the basin underside with an adhesive.

10. The urinal of claim 1, wherein the automatic flush system is configured to detect introduction of fluid into the basin and to send the flush signal after communication between the first capacitive sensor and the controller and the second capacitive sensor and the controller.

11. The urinal of claim 1, wherein the automatic flush system is configured to detect introduction of fluid into the basin and to send the flush signal after communication between each of the first capacitive sensor, second capacitive sensor, and the infrared presence sensor and the controller.

12. The urinal of claim 1, wherein one of the capacitive sensors is configured to detect a urinal normal state and a urinal abnormal state and the other is configured to detect introduction of fluid into the basin.

13. The urinal of claim 1, wherein the infrared sensor is in wired electrical communication with the controller.

14. The urinal of claim 1, wherein the wall comprises a shape configured to direct fluid flow towards the first capacitive sensor.

15. The urinal of claim 1, wherein the automatic flush system is configured to not send more than one flush signal during a time period of about 0.5 minutes.

16. An automatic flush system for a urinal having a basin to receive a fluid, a wall, a trapway in fluid communication with the basin, and a flush valve;

wherein the automatic flush system comprises a first capacitive sensor, a second capacitive sensor, an infrared presence sensor, and a controller, the first capacitive sensor is configured to be coupled to a rear surface of the wall, and the second capacitive sensor is configured to be coupled to an underside of the basin, and the controller is in wired electrical communication with the sensors and is in wired electrical communication with the flush valve, wherein, the automatic flush system is configured to detect introduction of a fluid into the basin;

to detect a urinal normal state wherein the fluid flows through the basin and trapway over a defined period of time, to detect a urinal abnormal clog state or abnormal slow-drain state wherein the fluid does not drain from the basin through the trapway, or drains from the basin slowly for more than a defined period of time, and to detect a urinal abnormal flush valve leak state wherein the fluid is introduced to the basin for more than a defined period of time, and wherein, the automatic flush system is configured to send a flush signal to the flush valve to initiate a flush if the urinal is in the normal state, and to not send a flush signal to the flush valve to initiate a flush if the urinal is in the abnormal clog state, the abnormal slow-drain-state, or the abnormal flush valve leak state.

* * * * *